US007794181B2

(12) United States Patent
Hendrick

(10) Patent No.: US 7,794,181 B2
(45) Date of Patent: Sep. 14, 2010

(54) MINE ROOF AND RIB SUPPORT DEVICE

(75) Inventor: Richard M. Hendrick, Goreville, IL (US)

(73) Assignee: FCI Holdings Delaware, Inc., Pittsburgh, PA (US)

( * ) Notice: Subject to any disclaimer, the term of this patent is extended or adjusted under 35 U.S.C. 154(b) by 112 days.

(21) Appl. No.: 12/023,195

(22) Filed: Jan. 31, 2008

(65) Prior Publication Data

US 2009/0285641 A1 Nov. 19, 2009

Related U.S. Application Data

(60) Provisional application No. 60/988,889, filed on Nov. 19, 2007.

(51) Int. Cl.
*E21D 21/00* (2006.01)

(52) U.S. Cl. ..... 405/302.3; 405/302.1

(58) Field of Classification Search ..... 405/302.1, 405/302.2, 302.3, 288; 248/235, 250, 295.11, 248/220.1, 300; 403/230, 321, 403; 52/288.1
See application file for complete search history.

(56) References Cited

U.S. PATENT DOCUMENTS

| | | | | |
|---|---|---|---|---|
| 1,797,925 | A | 3/1931 | Plym | |
| 1,946,733 | A | 2/1934 | Davis | |
| 2,027,882 | A | 1/1936 | Ross | |
| 2,317,634 | A | 4/1943 | Olsen | |
| 2,641,029 | A | 6/1953 | Trimmer | |
| 2,742,776 | A | 4/1956 | Peirce | |
| 3,003,600 | A * | 10/1961 | MacKenzie | 403/4 |
| 3,103,025 | A | 9/1963 | Gassner et al. | |
| 3,415,064 | A * | 12/1968 | Talobre | 405/302.1 |
| 3,485,405 | A | 12/1969 | Dement | |
| 3,543,463 | A | 12/1970 | Cannon | |
| 3,572,787 | A | 3/1971 | Timmerman et al. | |
| 3,587,205 | A | 6/1971 | Gartside et al. | |
| 3,928,716 | A * | 12/1975 | Marrero | 174/57 |
| 4,008,547 | A | 2/1977 | Katzman | |
| 4,325,657 | A * | 4/1982 | Elders | 405/302.1 |
| 4,456,405 | A | 6/1984 | Galis | |

(Continued)

FOREIGN PATENT DOCUMENTS

| | | |
|---|---|---|
| EP | 1081393 | 3/2001 |

(Continued)

*Primary Examiner*—Frederick L Lagman
(74) *Attorney, Agent, or Firm*—The Webb Law Firm

(57) ABSTRACT

A mine roof and rib support can be a support member having a roof support arm and a rib support arm, wherein the roof support arm is provided at an angle to the rib support arm. An aperture for a roof bolt is provided through the support member adjacent an intersection of the roof support arm and the rib support arm. A bearing plate having an upper edge and a lower edge, and a through-hole provided therebetween, can be provided wherein the upper and lower edges are positioned in abutment with the roof and rib support arms, respectively, to simultaneously apply force to each arm when a roof bolt is installed through each of the bearing plate and the support member. A flange can be provided at a distal end of one or both of the roof and rib support arms, each flange projecting toward the mine roof or rib.

10 Claims, 4 Drawing Sheets

U.S. PATENT DOCUMENTS 4,498,816 A * 2/1985 Korpela et al. ..... 405/302.1
4,513,554 A 4/1985 Johnson et al.
4,630,974 A 12/1986 Sherman
4,699,547 A * 10/1987 Seegmiller ..... 405/302.3
4,775,266 A 10/1988 Seegmiller
4,949,929 A * 8/1990 Kesselman et al. ..... 248/300
4,960,348 A 10/1990 Seegmiller
4,987,719 A 1/1991 Goodson, Jr.
5,292,209 A 3/1994 Calandra, Jr. et al.
5,385,433 A 1/1995 Calandra, Jr. et al.
5,755,535 A * 5/1998 Fox ..... 405/302.2
5,758,465 A * 6/1998 Logue ..... 403/403
RE35,902 E 9/1998 Calandra, Jr. et al.
6,131,361 A * 10/2000 Murphy ..... 248/300
6,250,041 B1 6/2001 Seccombe
6,612,087 B2 * 9/2003 diGirolamo et al. ..... 403/403
2006/0053714 A1 3/2006 Pryor et al.
2008/0283702 A1 * 11/2008 Ikerd ..... 248/228.1

FOREIGN PATENT DOCUMENTS

JP 06065921 3/2006

* cited by examiner

FIG. 6
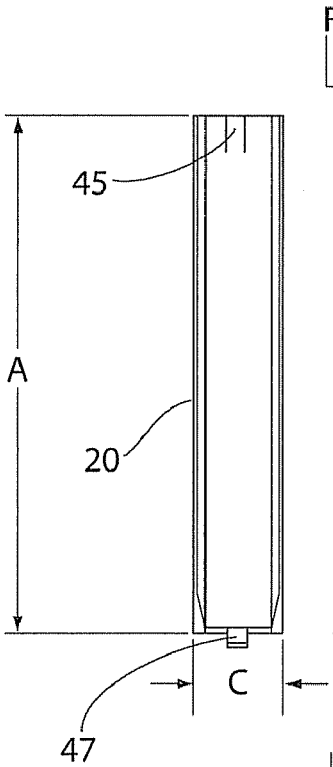
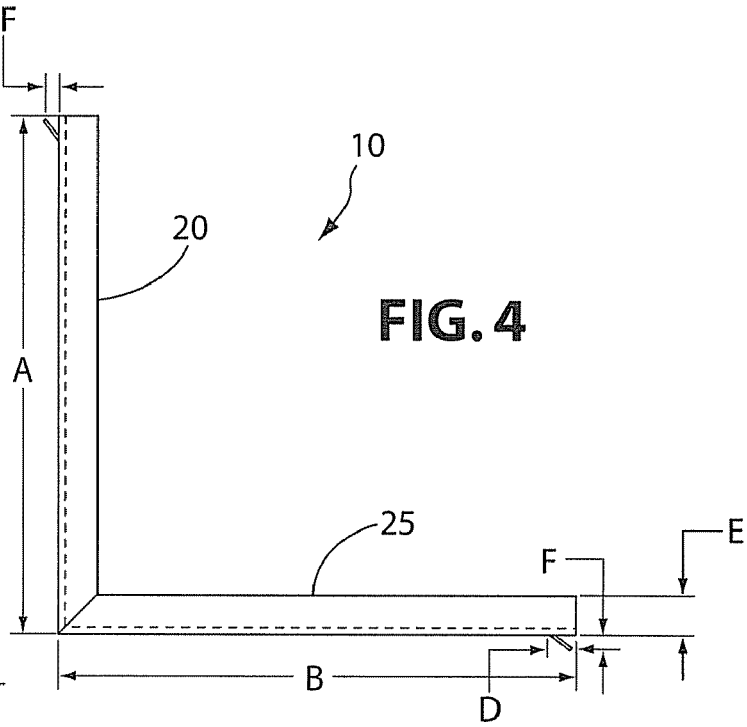
FIG. 4
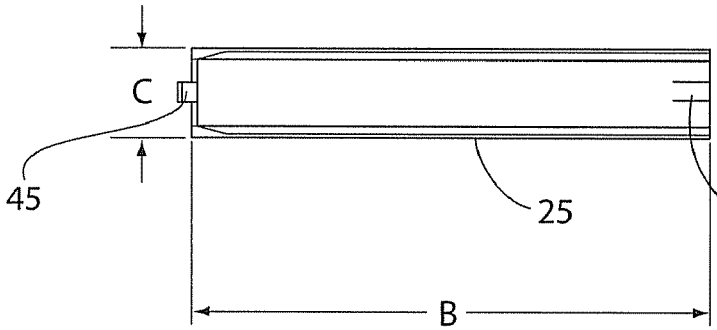
FIG. 5

MINE ROOF AND RIB SUPPORT DEVICE

RELATED APPLICATIONS

The present application claims priority to U.S. Provisional Patent Application Ser. No. 60/988,889 filed Nov. 19, 2007.

BACKGROUND

The support member relates generally to mine surface control, and more particularly to a mine roof and rib support with a roof support arm and a rib support arm which simultaneously support the mine roof and mine rib.

Mine roof and rib supports are commonly used in underground mining, excavating, and tunneling operations to support and control the overhead and lateral rock strata. In one conventional mine surface control system, a series of bore holes can be drilled into the mine roof or rib, a mine roof bolt can be installed in the bore hole, a channel, bearing plate, or mat can be positioned between the end of the mine roof bolt and the mine roof or rib, and the mine roof bolt can anchored in the bore hole and tensioned such that the mine roof bolt and channel, bearing plate, or mat exert a compressive force upon the mine roof and rib to prevent deterioration of the overhead and lateral rock strata.

Some examples of mine roof and rib support systems are described in U.S. Pat. No. 4,456,405 to Galis entitled "Mine Roof Truss Assembly and Associated Method", U.S. Pat. Nos. 5,385,433, 5,292,209, and RE 35,902 to Calandra, Jr. et al. entitled "Bearing Plate," U.S. Pat. No. 4,960,348 to Seegmiller entitled "Truss Systems, Components, and Methods for Trussing Arched Mine Roofs," U.S. Pat. No. 4,775,266 to Seegmiller entitled "Structure and Method for Deterring Cutter Roof Failure," and U.S. Pat. No. 4,630,974 to Sherman entitled "Roof Support System for a Mine and Method for Providing the Same."

SUMMARY

An embodiment of the mine roof and rib support device can generally comprise a support member having a roof support arm and a rib support arm, the roof support arm is provided at an angle to the rib support arm, and an aperture through the support member is provided for operatively receiving a mine roof bolt. The aperture can be located adjacent a junction between, or an intersection of, the roof support arm and the rib support arm. The support member can further comprise a flange provided on one, or both, of the roof support arm and the rib support arm, wherein the flange projects toward the mine roof and/or rib, respectively. The support member can be made from a metal channel having a C-shaped cross-section, and the metal channel can be bent to form each of the roof and rib support arms. The angle between the roof and rib support arms can generally be about 90 degrees, to generally correspond to usual angle between the mine roof and the mine rib, but the angle can be different if needed. The flanges can be bent from the distal ends of each of the roof and rib support arms to hold the mesh that can commonly be provided between the support arm and the mine roof and/or rib.

The mine roof and rib support device can further comprise a bearing plate having an upper edge and a lower edge, a through-hole provided between said upper and lower edges, and wherein said upper and lower edges are positioned in abutment with said roof support arm and said rib support arm, respectively, when the through-hole is operatively aligned with the aperture in the support member for installation of a roof bolt through each of the bearing plate and the support member, such that the upper and lower edges apply force to the roof and rib support arms, respectively, when force is applied to the bearing plate by installation of the roof bolt. In particular, the head of the mine roof bolt, or tensioning nut, can be torqued against the bearing plate such that the upper and lower edges of the bearing plate simultaneously exert force on each of the roof support arm and the rib support arm.

To the accomplishment of the foregoing and related ends, certain illustrative aspects of the mine roof and rib support device are described in the following description and drawing figures. These aspects may be indicative of but a few of the various ways in which the principles of the mine roof and rib support device may be employed, and which is intended to include all such aspects and any equivalents thereof. Other advantages and features of the mine roof and rib support may become apparent from the following detailed description when considered in conjunction with the drawing figures.

BRIEF DESCRIPTION OF THE DRAWING FIGURES

A more complete understanding of the mine roof and rib support can be obtained by considering the following description in conjunction with the accompanying drawing figures in which:

FIG. 4 is a front view of the support member shown in FIG. 3.

FIG. 5 is a side view of the support member in shown FIG. 4.

FIG. 6 is a bottom view of the support member in shown FIG. 4.

DESCRIPTION OF CERTAIN EMBODIMENTS

Figure 1:
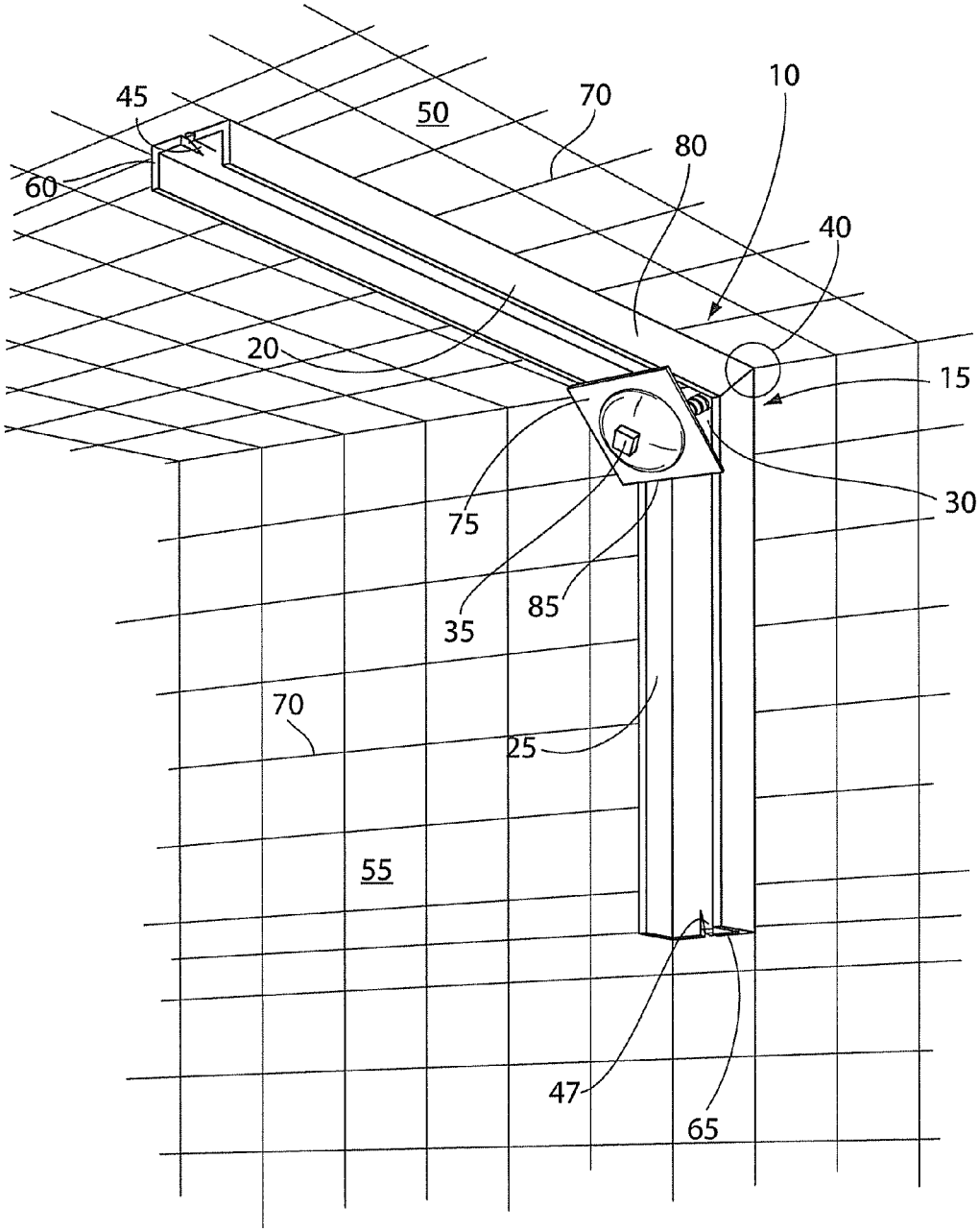
FIG. 1 is a perspective view of an embodiment of a mine roof and rib support device.
Figure 2:
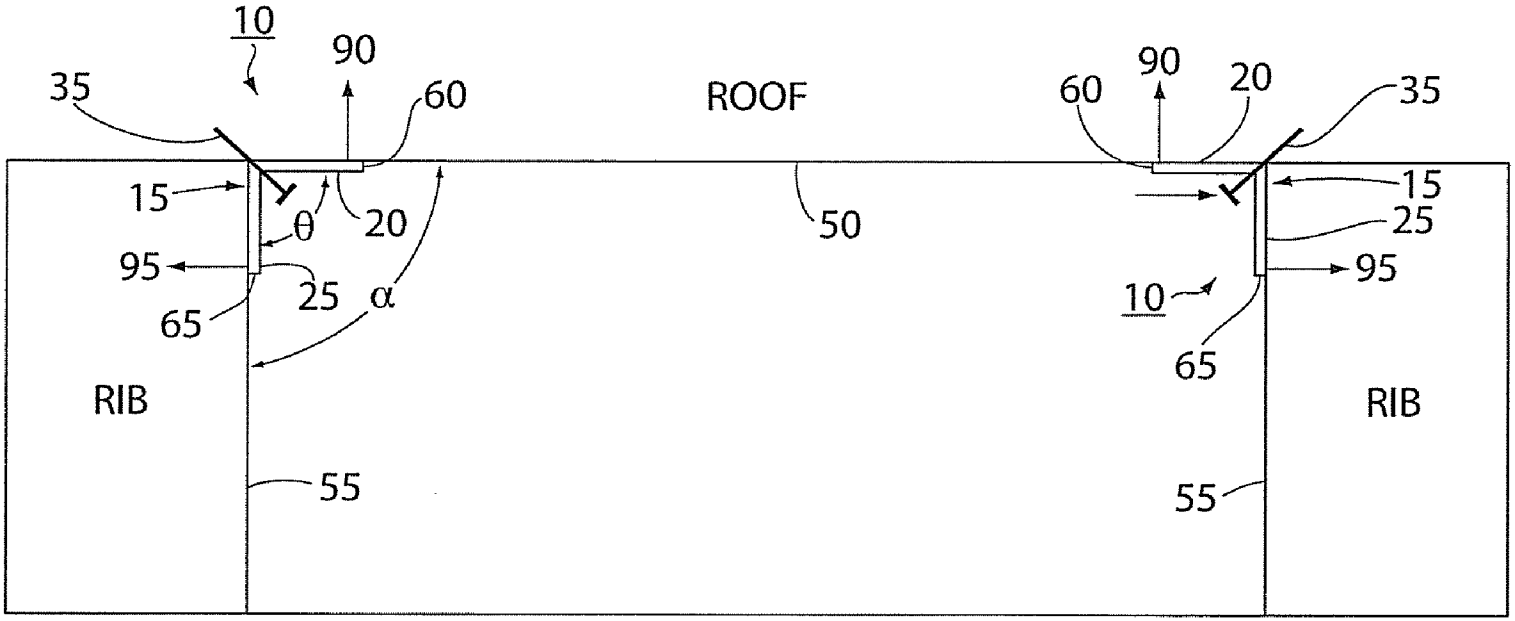
FIG. 2 is a front view illustrating embodiments of mine roof and rib support devices installed at the intersection of the mine roof and opposite sides/ribs of a mine work area.

Referring now to the drawing figures in which like reference numbers refer to like elements, a perspective view of an embodiment of a mine roof and rib support device 10 is shown in FIGS. 1 and 2, which can generally comprise a support member 15 having a roof support arm 20 and a rib support arm 25, wherein the roof support arm 20 is provided at an angle to the rib support arm 25, and an aperture 30 (shown best in FIG. 3) through the support member for receiving a mine roof bolt 35, the aperture located adjacent a junction between, or an intersection of, the roof support arm 20 and the rib support arm 25. The support member 15 can further comprise a flange 45 provided on one or both of the roof support arm 20 and the rib support arm 25, wherein the flange 45 projects toward the mine roof 50 or rib 55. In a further embodiment, flanges 45, 47 are provided at distal ends 50, 65 of both the roof support arm 20 and the rib support arm 25.

The angle $\theta$ between the roof 20 and rib 25 support arms can generally be about 90 degrees, since the angle $\alpha$ between the mine roof 50 and mine rib 55 is typically about 90 degrees. However, the angle $\theta$ between the arms 20, 25 can vary as needed, or desired, depending upon the angle between the mine roof 50 and the rib 55. Moreover, the angle $\alpha$ between the mine roof 50 and rib 55 may not be exactly 90 degrees, and the mine roof 50 and/or rib 55 may likely not be perfectly flat. Thus, embodiments of the support member 15 can be sufficiently flexible to compensate for variations in the angle $\alpha$ of the roof 50 and rib 55, and/or variations due to non-planar surfaces of the roof 50 and/or rib 55.

Figure 3:
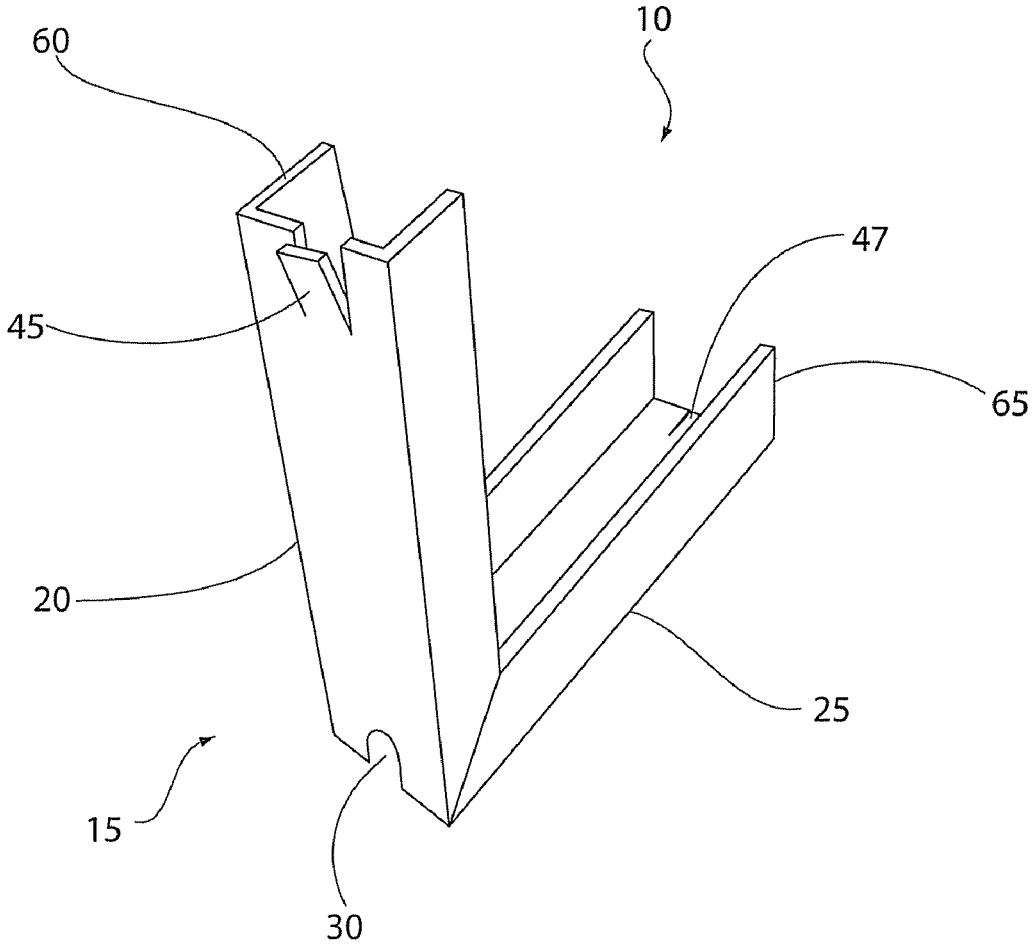
FIG. 3 is a perspective view of an embodiment of a support member of the mine roof and rib support device.

Referring to FIGS. 3 through 5, the flanges 45, 47 at the ends of the roof 20 and rib 25 support arms can be bent from the distal ends 60, 65 of each of the roof 20 and rib 25 support arms. In particular, for example, portions of the distal ends 60, 65 of each arm 20, 25 can be cut away to leave a tab, or extension, which can be bent to form the flanges 45, 47. The flanges 45, 47 can be bent toward the roof 50, or rib 55, as the flanges 45, 47 are intended to hold a mat, e.g., a metal mesh 70, in cases where such mesh 70 is used in combination with the roof support arm 20 and/or rib support arm 25.

Embodiments of the mine roof and rib support device 10 can further comprise a bearing plate 75 having an upper edge 80 and a lower edge 85, and a through-hole provided between the upper 80 and lower edges 85 through which the roof bolt 35 is installed. The bearing plate 75 can be positioned adjacent the support member 15 such that the upper 80 and lower edges 85 of the bearing plate 75 are positioned in abutment with the roof 20 and rib 25 support arms, respectively. When the through-hole in the bearing plate 75 is operatively aligned with the aperture 30 in the support member 15 for installation of a roof bolt 35 therethrough, the upper 80 and lower 85 edges will apply force to the roof 20 and rib 25 support arms, respectively, when force is applied to the bearing plate 75 by installation of the roof bolt 35. The roof bolt 35 can be installed at a 45 degree angle, but could be installed at a different angle if desired. When the mine roof bolt is torqued against the outer surface of the bearing plate, a compressive load is applied to the bearing plate. The compressive load is distributed throughout the edges of the bearing plate. The compressive load is transmitted from the edges of the bearing plate to the roof support arm and the rib support arm, respectively, to compress the support arms against the roof and rib of the mine tunnel. The compressive forces cause the roof support arm to exert pressure against the mine roof and the rib support arm to exert pressure against the mine rib.

FIG. 2 is a plan view illustrating how the mine roof and rib support device 10 may be installed at each side of the mine tunnel. Because the bearing plate 75 can distribute the force from the roof bolt 35 to each of the roof 20 and rib 25 support arms, a single roof bolt 35 can be used for each support member 15 to simultaneously provide support for both the mine roof 50 and the mine rib 55. The arrows 90, 95 in the drawing show the force vectors created by torquing the roof bolt 35 against the bearing plate 75.

FIGS. 3 through 6 illustrate further details of the support member 15, including the back surface of the support member shown in FIG. 3. As shown, the support member 15 can be made from a metal channel having a C-shaped cross-section. The metal channel can be bent to form each of the roof 20 and rib 25 support arms. Each arm 20, 25 can generally be the same length, but each arm 20, 25 could have a different length if desired. Certain embodiments of the support member 15 can be made from standard four (4) inch "C" channel steel with ¼ inch back wall thickness. The side walls of the channel can be split, or notched, adjacent the bend line, i.e., where the channel will be bent to form the roof 20 and rib 25 support arms at generally 90 degrees to each other. The notch facilitates not only bending the channel to form the roof 20 and rib 25 support arms, but also permits the arms 20, 25 some freedom of movement away from each other when the support member 15 is bolted to the mine roof 50. The bearing plate 75 will provide the support, similar to a brace, to resist movement of the roof 20 and rib 25 support arms towards each other subsequent to installation of the roof bolt 35. The channel can be heated to facilitate the bending process.

One manner of creating the flanges 45, 47 is to cut tabs at the distal end 60, 65, typically of both the roof 20 and rib 25 support arms, and then bend the tabs outwardly, away from the back of the channel, i.e., towards the mine roof/rib 50/55, to form the flanges, 45, 47 to engage the mesh 70 that is commonly disposed over the mine roof/rib 50, 55, under the support member 15.

In certain embodiments, the dimensions corresponding to the reference characters in FIGS. 4 through 6 can be, for example, as follows:

A=24 inches
B=24 inches
C=4 inches
D=1.5 inches
E=1.5 inches
F=0.65 inches

The exemplary embodiments shown can comprise an elongated metal structural support member having a C-shaped cross-section that will be typically be bent at an angle of about 90 degrees as described herein. However, this depiction is not intended to limit the various possible embodiments. The roof 20 and rib 25 support arms need not be bent from a single length of material, and could instead be two separate pieces of material which are, e.g., welded together. As used herein the term "upwardly" shall refer to a direction with respect to a mine passageway which is oriented generally along the direction extending from the mine floor to the mine roof, the term "downwardly" shall refer to a direction with respect to a mine passageway which is oriented generally along the direction extending from the mine roof to the mine floor, the term "outwardly" shall refer to an orientation generally in transverse direction extending from the walls of the passageway to the mine passageway central longitudinal axis, and the term "inwardly" shall refer to an orientation generally in transverse direction extending from the central longitudinal axis of the mine passageway to the walls of the passageway.

Therefore, what has been described above includes exemplary embodiments of a mine roof and rib support having a roof support arm and a rib support arm that can support both the roof and rib of the mine at the same time. It is, of course, not possible to describe every conceivable combination of components or methodologies for purposes of this description, but one of ordinary skill in the art may recognize that further combinations and permutations are possible in light of the overall teaching of this disclosure. Accordingly, the description provided herein is intended to be illustrative only, and should be considered to embrace any and all alterations, modifications, and/or variations that fall within the spirit and scope of the appended claims.

What is claimed is:

1. A mine roof and rib support comprising:

a. a support member having a roof support arm and a rib support arm, said roof support arm provided at an angle to said rib support arm; and b. an aperture through said support member for receiving a mine roof bolt, said aperture located at a junction between said roof support arm and said rib support arm.

2. The apparatus of claim 1 further comprising a flange provided on at least one of said roof support arm and said rib support arm, said flange projecting toward the mine roof or rib.

3. The apparatus of claim 2 further comprising said flange provided at a distal end of each of said roof and rib support arms, each flange projecting toward the mine roof or rib.

4. The apparatus of claim 3 wherein said support member comprises a metal channel having a C-shaped cross-section.

5. The apparatus of claim 4 wherein said metal channel is bent to form each of said roof and rib support arms, and each of said flanges is bent from said distal ends of each of said roof and rib support arms.

6. A mine roof and rib support comprising:

a. a support member having a roof support arm and a rib support arm, said roof support arm provided at an angle to said rib support arm; and b. an aperture through said support member for receiving a mine roof bolt, said aperture located adjacent a junction between said roof support arm and said rib support arm; and c. a bearing plate having an upper edge, a lower edge and a through- hole provided between said upper and lower edges;

wherein said upper and lower edges are positioned in abutment with said roof and rib support arms, respectively, when said through-hole is operatively aligned with said aperture for installation of a roof bolt through each of said bearing plate and said support member, such that said upper and lower edges apply force to said roof and rib support arms, respectively, when force is applied to said bearing plate by installation of the roof bolt.

7. The apparatus of claim 6 further comprising a flange provided on at least one of said roof support arm and said rib support arm, said flange projecting toward the mine roof or rib.

8. The apparatus of claim 7 further comprising said flange provided at a distal end of each of said roof and rib support arms, each flange projecting toward the mine roof or rib.

9. The apparatus of claim 8 wherein said support member comprises a metal channel having a C-shaped cross-section.

10. The apparatus of claim 9 wherein said metal channel is bent to form each of said roof and rib support arms, and each of said flanges is bent from said distal ends of each of said roof and rib support arms.

* * * * *